US005888693A

United States Patent [19]

Meschter et al.

[11] Patent Number: 5,888,693

[45] Date of Patent: Mar. 30, 1999

[54] FILM ASSEMBLY

[75] Inventors: John E. Meschter, Stow; Philip R. Norris, North Reading; Harry R. Parsons, Burlington, all of Mass.

[73] Assignee: Polaroid Corporation, Cambridge, Mass.

[21] Appl. No.: 958,902

[22] Filed: Oct. 28, 1997

[51] Int. Cl.[6] ..... G03C 8/44; G03C 8/46; G03C 8/48

[52] U.S. Cl. ..... 430/208; 430/207; 430/209; 430/498; 396/364; 396/583

[58] Field of Search ..... 430/207, 208, 430/209, 498; 396/364, 583

[56] References Cited

U.S. PATENT DOCUMENTS

| | | | |
|---|---|---|---|
| 3,636,845 | 1/1972 | Harvey | 96/13 |
| 3,767,405 | 10/1973 | Harvey | 430/209 |
| 3,933,555 | 1/1976 | Downey | 156/155 |
| 4,042,395 | 8/1977 | Tone et al. | 430/209 |
| 4,556,631 | 12/1985 | Sato et al. | 430/209 |
| 4,824,761 | 4/1989 | Sturgis et al. | 430/209 |
| 5,023,163 | 6/1991 | Simizu et al. | 430/209 |

*Primary Examiner*—Richard L. Schilling
*Attorney, Agent, or Firm*—Leslie Payne

[57] ABSTRACT

An improved self-developing film unit comprising: processing fluid supply means including a rupturable reservoir of processing fluid at a leading end portion of the unit; image recording means of the self-developing type including first and second overlying layers one of which is exposable to form a latent photographic image, and spacer means connected to and between said first and second layers for providing a processing space therebetween for allowing processing fluid to pass therethrough; fluid trap means at a trailing end portion of the film unit for collecting excess processing fluid traveling through said processing space; first fluid-tight coupling means including a fluid passage for fluidically coupling said reservoir to a leading end of said processing space for allowing processing fluid from a ruptured reservoir to be introduced into said processing space and initiate processing of the latent image; and, second fluid-tight coupling means including a fluid passage for fluidically coupling a trailing end of said processing space with said trap means for allowing processing fluid to enter into said trap means; said first coupling means having one end portion sealably secured to an exterior surface of said reservoir and a second end portion sealably secured to an exterior surface of a leading end portion of said image recording means; and, said second coupling means having an end portion sealably secured to and about the trailing end portion of said image recording means and an opposite end portion sealably secured to an exterior surface of said trap means.

20 Claims, 5 Drawing Sheets

FILM ASSEMBLY

CROSS-REFERENCE TO RELATED APPLICATIONS

The present application is related to co-pending non-provisional U.S. patent application, Ser. No. 08/808,040 entitled "Photographic Apparatus and Method" by Philip R. Norris and filed in the U.S. Patent and Trademark Office on Mar. 4, 1997, which is incorporated herein by reference and U.S. provisional application Ser. No.: 60/040,797.

BACKGROUND OF THE INVENTION

1. Field of the Invention

This invention relates in general to an assemblage of photographic film units of the instant or self-developing type, and in particular to an assemblage wherein the individual film units are joined by interposed connection strips to form a continuous strip adapted for space-saving packaging of the assemblage and easy separation into individual images after exposure and processing.

2. Description of the Prior Art

Film assemblages of the self-developing type have been provided in various forms in the prior art. The film assemblages generally comprise two separate superposed or superposable members which are in form of a first or photosensitive member and a second or image-receiving member. The first member includes a layer containing a photosensitive material on a support sheet. The second member, which may be transparent, receives the image from the layer on the first member upon contact with the exposed area of the layer in the presence of processing liquid spread between the first and second member.

The two superposed members are generally held together by a masking member provided with an opening to frame the image on the image-receiving member. A rupturable container containing processing liquid, commonly referred to in the art as "pod", is located at one end of the masking member and a trap for collecting any excess processing liquid is located at the opposite end of the masking member.

A film assemblage of the general type described above is disclosed, for example, in the U.S. Pat. No. 4,042,395 granted to F. F. Tone et al., and U.S. Pat. No. 4,824,761, granted to J. I. Sturgis et al. In these U.S. Pat. No. 4,042,395 and 4,824,761, the masking members extend lengthwise substantially over the end portions of the image-receiving and photosensitive members in order to form sealed compartments for the rupturable container and the trap when folded back upon itself. The image-receiving member is longer than the photosensitive member, thereby wasting expensive photographic material.

In U.S. Pat. No. 3,767,405, granted to D. M. Harvey, there is disclosed an integral film unit wherein the image-receiving and photosensitive members are essentially coextensive, wherein the trap is formed by a rigid, elongated shell-like cover slipped on the ends of the members, and wherein the rupturable container is connected to the leading end of the integral film unit by an elongated funnel inserted between the members near the leading edge for improving the distribution of the processing fluid and the uniformity of processing. The funnel is sufficiently elongated as to permit the rupturable container to be moved from a superposed relationship to a substantially coplanar, end-to-end relationship, as illustrated in FIGS. 1 and 2 of the patent. The rupturable container is attached to a carrier of substantially the same lateral dimensions as the photosensitive portion.

U.S. Pat. No. 3,635,139 describes an assemblage of self-processing film units interconnected by a foldable web provided with a series of longitudinally extending flaps cut from the web. The web serves primarily to support the individual film units which still have to be assembled separately.

In U.S. Pat. No. 4,735,886, granted to Y. Oshikoshi et. al., there is disclosed a self-developing photographic method and apparatus, wherein a photosensitive member supplied from a first roll is superposed after exposure with an image-receiving member, together with a rupturable container, provided from a second roll, wherein both members are cut from the roll inside the apparatus after exposure and wherein the photosensitive member has lateral dimensions substantially larger than the image area.

Each film unit with its associated rupturable container and trap portion has to be individually assembled in place from its individual components, i.e. generally separate rolls of image-receiving, photosensitive and masking material, all of which are not necessarily of identical size and have to be matched for optimum imaging performance due to sensitometric variations during manufacture. Further, the lateral dimensions of the film unit are generally noticeably larger than the imaging area as a result of the space taken up by the rupturable container and the trap. Pack film where film units are stored in a package in a superposed arrangement, i.e. forming a stack, have the additional disadvantage that the film unit to be exposed in a cooperating camera is the topmost film unit, requiring spring-biasing of the entire stack of unexposed film units towards the camera lens for achieving the desired film flatness in the image plane.

SUMMARY OF THE INVENTION

According to the present invention there is provided an improved self-developing film unit. Provision is made for: a processing fluid supply assembly including a rupturable reservoir of processing fluid at a leading end portion of the unit; a self-developing image recording assembly including first and second overlying layers, one of the layers is exposable to form a latent photographic image, and a spacer assembly is connected to and between the first and second layers for providing a processing space therebetween which allows processing fluid to pass therethrough; fluid trap assembly at a trailing end portion of the film unit for collecting excess processing fluid traveling through the processing space; first fluid-tight coupling assembly including a fluid passage for fluidically coupling the reservoir to a leading end of the processing space for allowing processing fluid from a ruptured reservoir to be introduced into the processing space and initiate processing of the latent image; and, second fluid-tight coupling assembly including a fluid passage for fluidically coupling a trailing end of the processing space with the trap assembly for allowing processing fluid to enter into the trap assembly. The first coupling assembly has one end portion sealably secured to an exterior surface of the reservoir and a second end portion sealably secured to an exterior surface of a leading end portion of the image recording assembly. The second coupling assembly has an end portion sealably secured to and about the trailing end portion of the image recording assembly and an opposite end portion sealably secured to an exterior surface of the trap assembly.

In an illustrated embodiment the image recording assembly comprises a photosensitive layer, and an image receiving layer in overlying and coextensive relationship to the photosensitive layer. The image receiving layer and the photosensitive layer is of the integral diffusion transfer type; and, the spacer assembly means comprises a pair of spaced apart and generally parallel elongated rails coextensive with and adjacent opposed marginal edges of the layers. In such embodiment, provision is made wherein each of the first and second fluid-tight coupling assembly is made of a pair of resiliently flexible sheets which are sealably joined together to define the respective fluid passages and which are made of a foldable and rollable material to thereby facilitate folding and unfolding thereof as well as permit rolling action thereof during unfolding of the film unit.

In another illustrated embodiment provision is made for having a plurality of film units being interconnected together in longitudinally extending end-to-end relationship to each other with a leading end portion of the reservoir of one film unit being juxtaposed to a trailing end portion of an adjacent film unit; and, means separably interconnecting each linear pair of film units connected in end-to-end relationship. In another illustrated embodiment, provision is made for the interconnecting means to include an interconnecting sheet forming a portion of the first coupling means at one end and a second coupling means at the other end.

Provision is also made to methods of forming a self-developing film unit of the above type.

It is an object of the present invention to provide a new and improved film assemblage which is relatively simple in structure, relatively inexpensive to manufacture, simple and easy to use, and can be used in a variety of photographic applications.

It is another object of the invention to provide an assemblage of self-processing film units joined together end-to-end with discrete connection strips and/or fluid passageways for the processing liquid in alternating arrangement to form a longitudinal strip.

It is a further object to fabricate the assemblage from individual film units comprising rectangular portions cut widthwise from pre-assembled superposed image-receiving and photosensitive rolls or sheets with a pair of lengthwise interposed mask or rail sections along the marginal edges. As a result, the high precision sensitometric film assembly can be separated from the less precise assembly process of the film assemblage.

It is another object of the invention to provide fluid passageways which contain only insignificant amounts of residual processing liquid after processing, thereby eliminating undesirable "back-flow" into the film unit.

It is a further object of the invention to provide a film assemblage that can be successfully packaged in small or large quantity packages without risking premature rupture of the rupturable container or adversely affecting flatness at the unit at the focal plane.

It is a further object of the invention to provide a film assemblage that can be successfully packaged in small or large quantity packages without risking premature rupture of the rupturable container or adversely affecting flatness at the unit at the focal plane.

Additionally, it is an object of the invention to enable manual processing of the exposed film units and easy separation of adjacent film units.

To meet these and other objects, the present invention provides a plurality of self-developing film units secured end-to-end to preferably foldable connection strips in alternating arrangement to form a longitudinal strip, rupturable containers containing processing liquid and traps for receiving excess processing liquid secured to said connection strips, one or more cover strips secured to each connection strip and to the film units in a liquid-tight manner for providing a fluid passageway for conveying the processing liquid from the rupturable container to the associated film unit and excess processing liquid after processing from said film unit to the associated trap, without leaving significant amounts of processing liquid in longitudinally extending separation spaces between the film unit and the rupturable container and trap, respectively. The separation spaces can be advantageously employed to enable folding of the assemblage for facilitating space-saving stacking of film units in a cooperating film container.

The connection strips and cover strips may preferably be adapted for allowing separation of one film unit from the adjacent film unit by, for example, a perforation or an otherwise structurally weakened section of the connection strips and/or covers.

In addition, the dimensions of the elements of the assemblage and their structural arrangement are selected such as to enable simple and inexpensive manufacture, space-saving packaging and easy cooperation with an exposure device, such as a camera.

Whereas the invention will be described hereinafter in relation to integral film units, it will be understood by those skilled in the art, that the invention can be equally practiced using peel-apart film.

In addition, the present invention contemplates that the connection strips and cover strips can be replaced by a single member defining a fluid passageway for allowing processing fluid to pass from the rupturable container to the film unit and from the film unit to the trap.

Other objects and attainments together with a fuller understanding of the invention will become apparent and appreciated by referring to the following description and claims taken in conjunction with the accompanying drawings.

BRIEF DESCRIPTION OF THE DRAWINGS

In the following Figures, like parts or components and/or like functions of parts or components are referenced with the same numerals, and not all numerals are shown on all figures for sake of clarity.

In the drawing is shown in.

DETAILED DESCRIPTION

Figure 1:
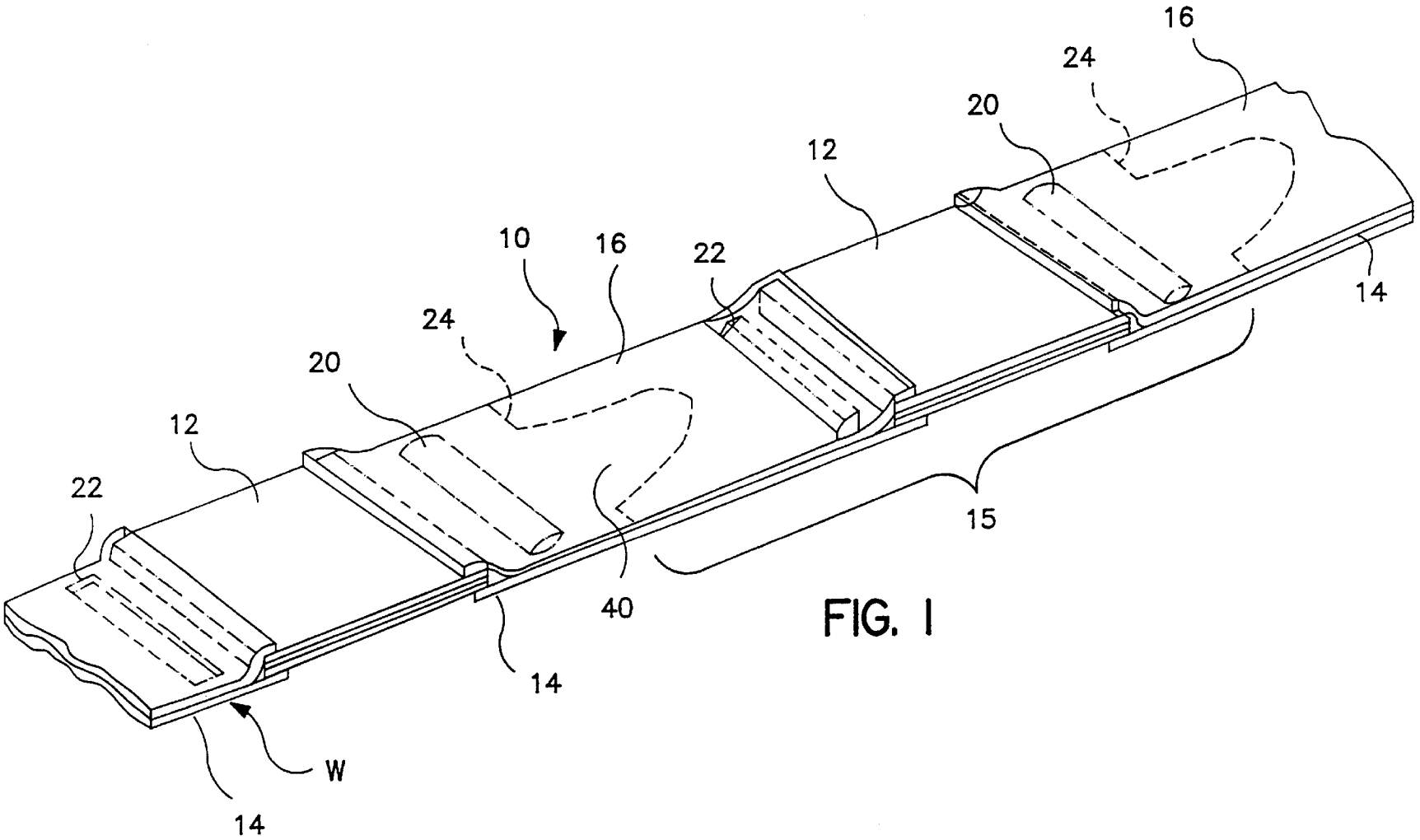
FIG. 1 a perspective view of the film assemblage of the invention.

Referring now to FIG. 1, there is shown a perspective view of a photographic film assemblage 10 of the invention comprising self-developing film units 12 secured end-to-end to connection strips 14 in alternating arrangement to form a longitudinal strip. The film assemblage 10 is conveniently subdivided into image units or frames 15 extending lengthwise from a weakened section 24 on one connection strip 14 to the equivalent location 24 on the adjacent connection strip 14. As will be discussed below, the weakened sections 24 preferably represent structurally weakened sections intended to permit easy separation of successive image units 15.

Each image unit 15 comprises the film unit 12, a rupturable container 20 ("pod") with processing fluid adjacent the leading edge of the film unit 12 and containing processing liquid, a trap 22 adjacent the trailing edge of the film unit 12 adapted to receive excess processing liquid not consumed during processing of the film unit 12 in a cooperating exposure device, such as a camera (not shown). Both the rupturable container 20 and the trap 22 are attached to the connection strip 14 by, for example, adhesives. The functionality of rupturable containers and traps relating to self-developing film is well known in the art. The connecting strips and cover strips can be made of, for example, a polyester material having a thickness of about 0.1 mm, preferably less, as is also known in the art.

Although the film unit 12 depicted in the FIGS. 1 through 4 is of the integral type, wherein the image-receiving member 30 and the photosensitive member 32 are retained intact after photographic processing, the film unit 12 may also be of the peel-apart type, wherein the respective members are separated after processing. Such integral and peel-apart film units are well known in the art.

A liquid-tight fluid passageway is provided between the rupturable container 20 and the leading edge of the film unit 12, and between the trailing edge of the film unit 12 and the trap 22. In one embodiment, a cover strip 16 generally coextensive in width with the connection strip 14 is disposed on top of the connection strip 14 and secured at its respective ends to the leading and trailing edges, respectively, of the film unit 12 by, for example, an adhesive. Furthermore, the connection strip 14 is secured and sealed fluid-tight along the side marginal portions 26*a*, 26*b* proximate to the rupturable container 20 and along the side marginal portions 28*a*, 28*b* proximate to the trap 22. In the region between the rupturable container 20 and the trap 22, the connection strip 14 and the cover strip 16 are affixed, such as by adhesives or by heat-sealing, to each other in a manner to seal in a liquid-tight manner the rupturable container 20 and trap 22 from the environment, for example by co-lamination.

The assembly and cooperation of the various components and elements of the film assemblage 10 of the invention are best understood with reference to FIGS. 2*a* to 2*d*, showing a top plan view and side views in various stages of assembly.

The connection strip 14 having a length $L_C$ is secured in a liquid-tight manner, for example by heat sealing, along respective lateral portions 42*a*, 42*b* to the film units 12 end-to-end in an alternating arrangement. The rupturable container 20 having a length $L_P$ is attached to the connection strip 14, for example by adhesives or lamination using heat and/or pressure. The edge of the rupturable container 20 adjacent the film unit 12 is spaced from the film unit 12 by a distance $L_P'$. For reasons which will become apparent later, the spacing $L_P'$ should preferably be at least equal to the length $L_P$ of the rupturable container 20. In a similar fashion, the trap 22 having a length $L_T$ is attached to the connection strip 14, for example by lamination. The construction of the trap 22 will be discussed in greater detail below. Here again, the spacing $L_T'$ between the trap and the trailing edge of the film unit 12 should preferably be at least equal to the length $L_T$ of the trap for reasons which will appear later.

Figure 2A:
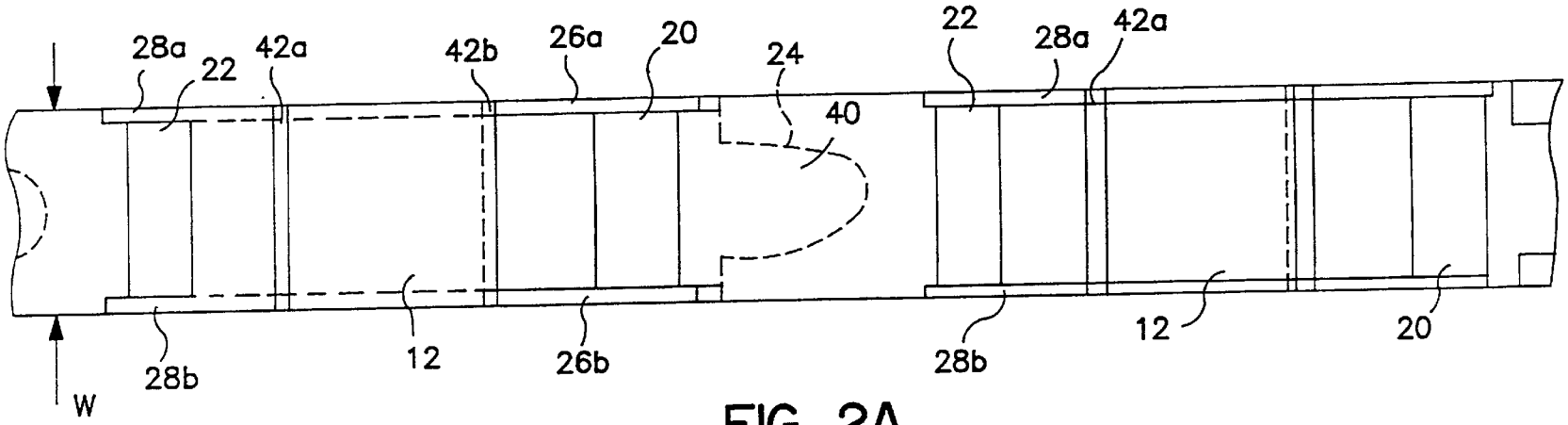
FIG. 2*a* a top plan view of the film assemblage of the invention.
Figure 2B:
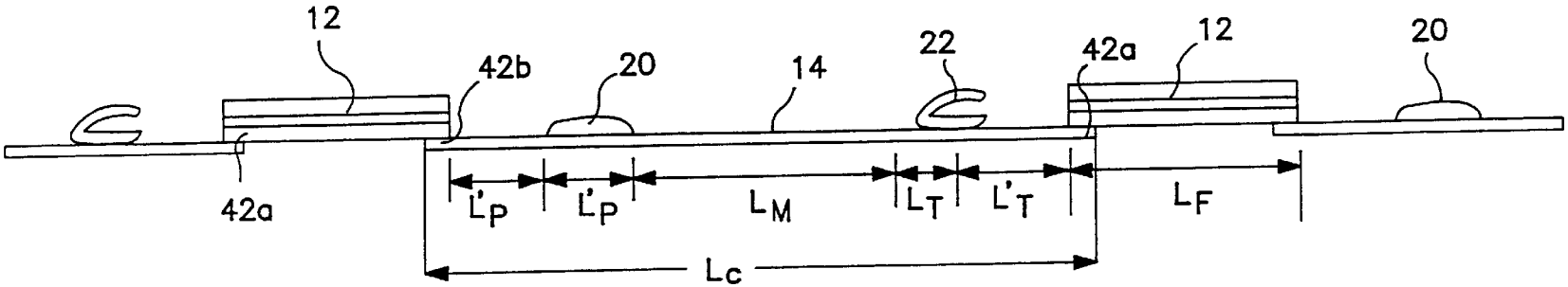
FIG. 2*b* a side view of the film assemblage of FIG. 2*a* during assembly.
Figure 2C:
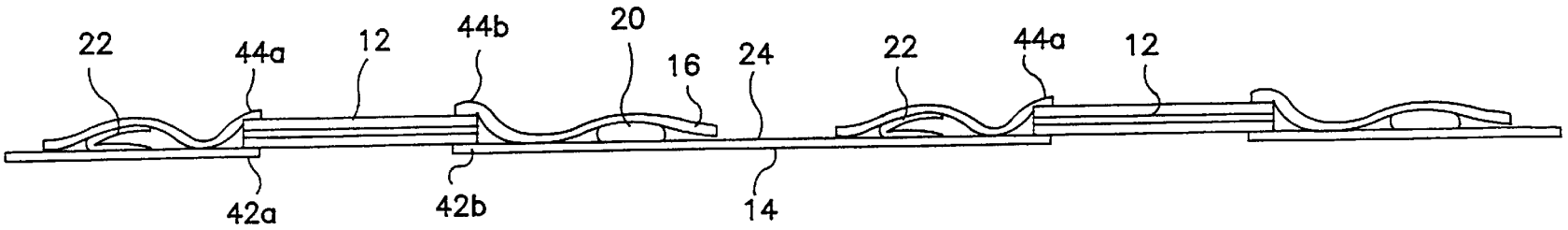
FIG. 2*c* a side view of an embodiment of the film assemblage of FIG. 2*a* after assembly.
Figure 2D:
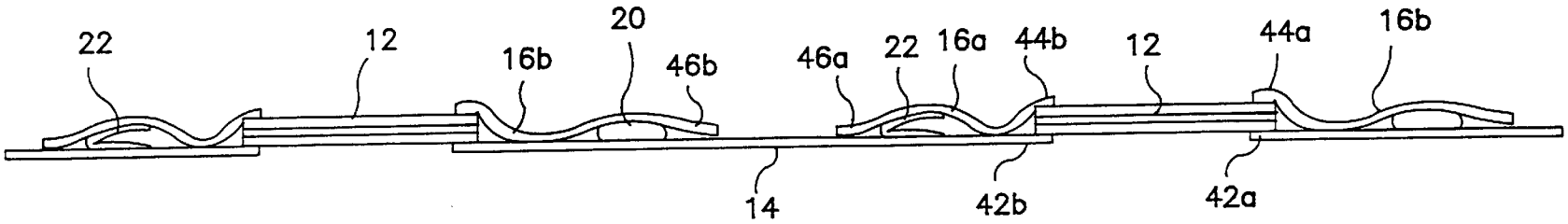
FIG. 2*d* a side view of another embodiment of the film assemblage of FIG. 2*a* after assembly.

In FIGS. 2*c* and 2*d*, there are depicted two different embodiments for providing a sealed fluid passageway for the processing liquid from the rupturable container 20 to the leading edge of the film unit 12 and from the trailing edge of the film unit 12 to the trap 22.

Referring first to FIG. 2*c*, in a first embodiment, there is provided one cover strip 16 for each connection strip 14. The cover strip 16 has substantially the same length and the same width as the connection strip 14 and is placed in coextensive registration with and secured to the connection strip 14 in the manner described above, e.g. by sealing along marginal edges 26*a*, 26*b*, 28*a*, 28*b* and in the region between the rupturable container 20 and the trap 22. Instead of using a cover strip 16 separate from the connection strip 14 for providing the fluid passageway, a single connection strip having a width 2×W may be employed which is medially foldable lengthwise. One half of that connection strip is secured to the film units 12 analogous to connection strip 14 above and the other half assumes the role of the cover strip 16 above. As already noted above, the fluid passageway may also be made of a single member.

As previously noted, the film assemblage 10 is preferably provided with structurally weakened sections 24. The sections 24 are weakened by, for example, perforations for facilitating separation of adjacent image units 15. The perforation preferably define a tab 40, as is illustrated, and is useful for pulling a leading image unit 15 out of a cooperating camera (not shown), thus facilitating manual processing and allowing an inexpensive camera design. The tab 40 remains after the separation at a preceding image unit. It would, however, be apparent to those skilled in the art that other method suitable for separating successive image units 15, for example notches along the marginal lateral edges or external cutters, could also be employed and the existence of a tab and the location and shape thereof depicted in the figures should be only understood as an exemplary preferred embodiment of the invention.

In another embodiment of the invention, depicted in FIG. 2*d*, the contiguous cover strip 16 of FIG. 2*c* is replaced by a first cover strip 16*b* covering and sealing the region extending over the rupturable container 20 and the leading edge of the film unit 12, with a preferably liquid-tight seal along the edge 46*b*, and by a second cover strip 16*a* covering and sealing the region extending over the trap 22 and the trailing edge of the film unit 12, with a preferably liquid-tight seal along the edge 46*a*. It is readily apparent that the two seals 46*a* and 46*b* have the same functionality as the sealing region between the rupturable container 20 and the trap 22 located on the same connection strip 14 when a continuous cover strip 16 is employed.

Figure 3:
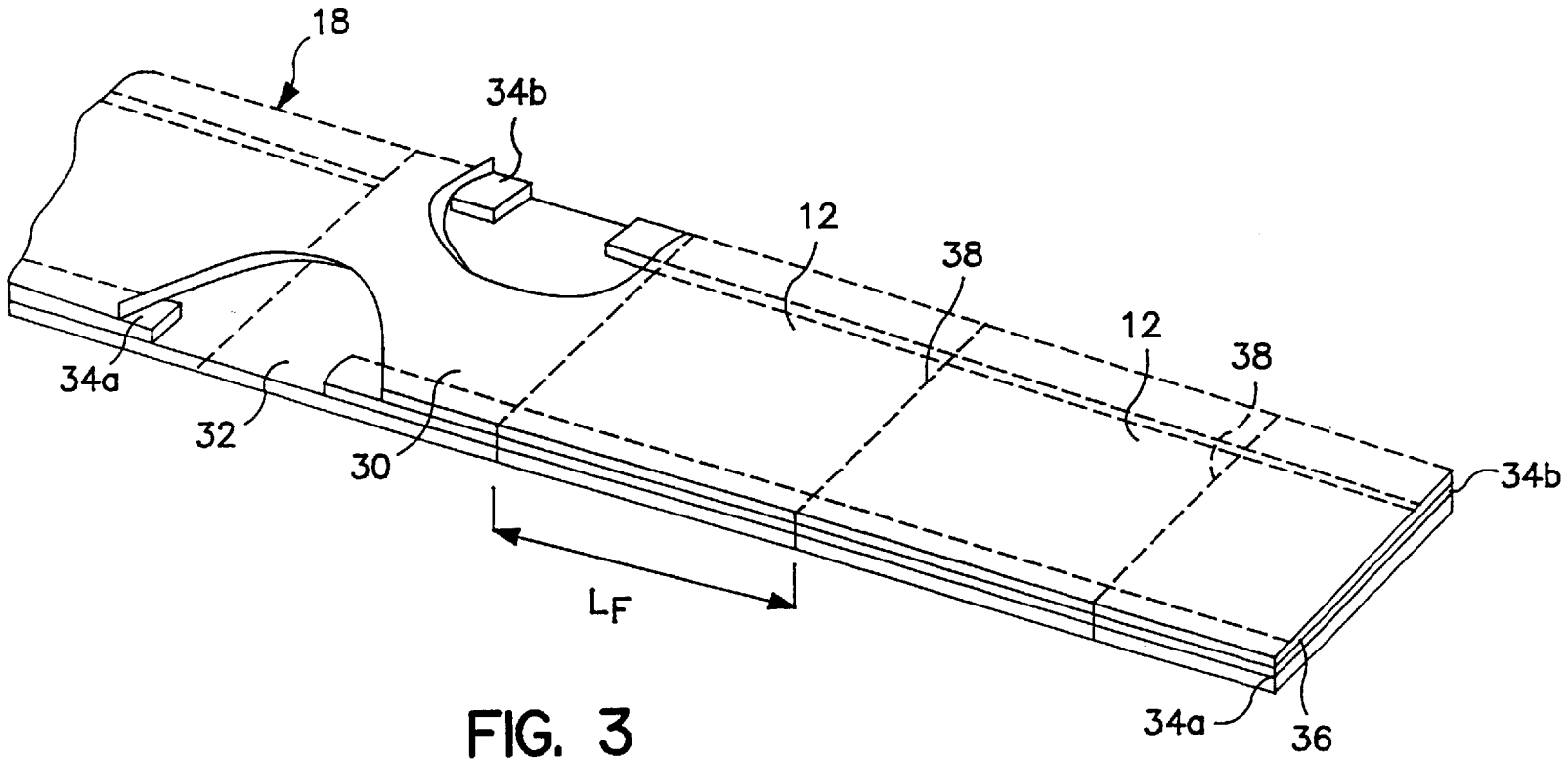
FIG. 3 a perspective, partially broken out view of the construction of the integral film strip before separation into individual film units used for making the film assemblage of the invention.

Referring now to FIG. 3, there is shown the structure of the individual film units 12 forming a part of the film assemblage 10. A film supply 18, in form of a roll or a sheet, having about the width W of the film assemblage 10 and comprising an image-receiving member 30 and an photosensitive member 32 spaced apart by preferably continuous rail sections 34*a*, 34*b* extending along the marginal edges of the film supply 18 and secured to the member 30 and member 32, is manufactured in a manner known in the art from a sensitometrically matched image-receiving member 30 and a photosensitive member 32 material. Individual film units 12 of length $L_F$ are subsequently severed, for example cut with a mechanical device, a laser or the like, from the film supply 18 along separations 38. The two members 30, 32 and the rail sections 34*a*, 34*b* define a lateral opening 36 therebetween for providing a passage of the processing liquid. The image-receiving member 30 and an photosensitive member 32 of each individual film unit 12 are most preferably coextensive, and the rail sections are most preferably coextensive with the marginal edges over the entire length of the film unit 12. The film units 12 therefore do not require additional processing after separation. Although the separation cuts are preferably perpendicular to the film surface, the cuts may also be angled in order to provide less volume for any residual processing liquid left in the space proximate to the leading and trailing edges, respectively, of the film unit 12.

During processing of the image unit 15 in a cooperating camera, rollers (not shown) rupture the rupturable container 20 and spread the processing liquid from the rupturable container 20 to the leading edge of film unit 12, into the opening 36 and through the film unit 12 Any excess processing liquid exits at the trailing edge of film unit 12 and travels to the trap 22. In conventional self-developing film, it is desirable to keep the length of spacings $L_P'$ and $L_T'$, respectively, as short as possible since these dimensions as well as the dimensions $L_P$ and $L_T$ contribute to the dimensions of the film package, but not to the image area.

In the present invention, $L_P'$ is selected to be at least about as large as $L_P$, and $L_T'$ is selected to be at least about as large as $L_T$. As a result of this choice of dimensions, the rollers in a cooperating camera (not shown) used to spread the processing liquid in image unit 15 press the cover strip 16 (and 16*a*, 16*b*) firmly against the connection strip 14 between rupturable container 20 and film unit 12, and between trap 22 and film unit 12, respectively. Consequently, an essentially "zero gap" remains between the connection strip 14 and the cover strip 16 containing only insignificant amounts of residual processing liquid capable of "blowing back" into the openings 36 of the film unit 12 and causing undesirable image artifacts. Another advantage is that the "stiff" sections of the image unit 15, i.e. the sections where the rupturable container 20 and the trap 22 are secured to the connection strip 14, can be withdrawn from the cooperating camera without bending whereas all other sections of the connection strip 14 are easily flexed. This aspect of the invention will be discussed in more detail below.

Another feature of the invention is an efficient trap, as illustrated schematically in FIGS. 1 and 2*a*–2*c*. The individual traps 22 are preferably made by securing, e.g. laminating, one side of a trap material known in the art, for example an absorbent material impregnated with acid for neutralizing any excess processing liquid, to a preferably flexible sheet and by then folding the sheet medially lengthwise, so that the sheet forms a V with the trap material on the inside of one leg of the V and facing the other leg. The traps 22 are preferably cut from a continuous sheet (not shown) to proper length corresponding approximately to the width W of the film assemblage 10. The open "mouth" of the V faces the trailing edge of the film unit 12. The trap 22 may be secured to the connection strip 14, to the cover strip 16 or both. The fold side of the trap 22 provides additional strength for safely arresting the flow of excess processing liquid in front of the advancing rollers.

Alternately, the trap 22 may also be constructed of trap tape only, i.e. without requiring the sheet, and folded in a manner to yield a V-shaped trap 22 having substantially identical dimensions as the aforedescribed trap construction.

As a result of the choice of longitudinal dimension discussed above, particularly $L_P$ about equal to $L_P'$, $L_T$ about equal to $L_T'$, and $L_M$ about equal to $L_F$, the film assemblage 10 can be folded such that both the film package folded in a light-tight container and the size of the photographic print are not substantially larger than the image area. This is illustrated FIGS. 4 and 5.

Figure 4:
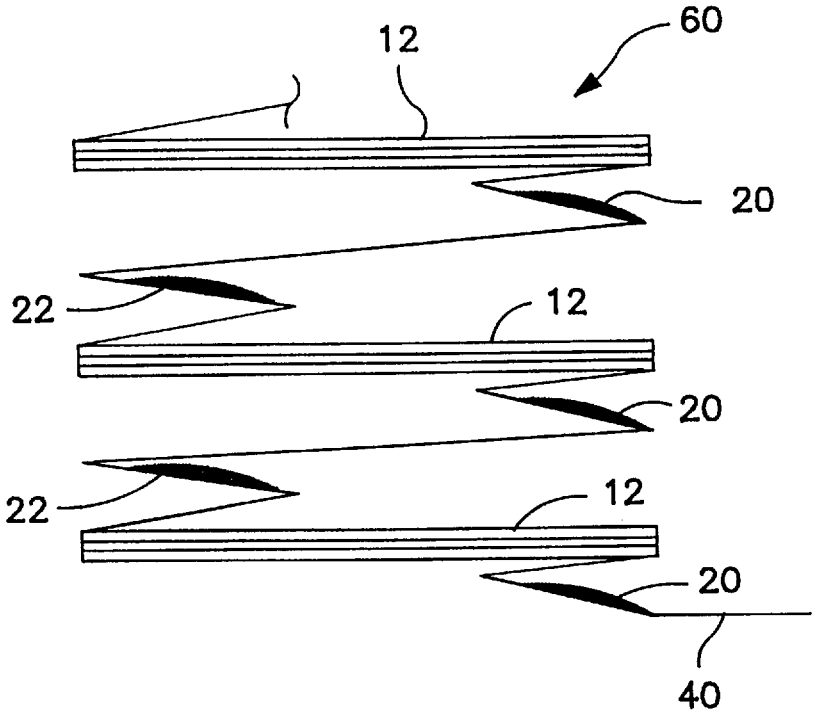
FIG. 4 a schematic illustration of the assemblage of FIG. 1 arranged in a stack adapted for storage in a camera.

FIG. 4 shows an arrangement for storing the film, for example in a cooperating light-tight film container or camera (not shown), in form of a stack 60 by folding the connection strips 14 (including, of course, the coextensive cover strips 16, or 16*a*, 16*b*, respectively) near the leading and trailing edges, respectively, of the rupturable containers 20, the traps 22 and the film units 12 in a W-M configuration as indicated in the figure. In a cooperating camera, the image unit 15 (see FIG. 1) would be withdrawn to the right in FIG. 4 to an exposure zone (not shown). As is apparent from FIG. 4, when the image unit 15 is withdrawn, the stiff segments comprising the rupturable container 20, the film unit 12 and the trap 22 exit the stack 60 without rotating or bending; only the flexible sections comprising the connection strip 14 and cover strip 16 are flexed. In addition, in contrast to the operation of a camera using conventional self-developing film unit, successive image units 15 are pulled for exposure from the bottom of the stack 60 and conveyed to the exposure zone (not shown) to the right of tab 40. There, only said one image unit 15 has to be held flat in the focal plane which simplifies the construction of the light-tight container (not shown) in that no springs for urging the film into the focal plane have to be provided. It is known in the art that maintaining focal plane flatness from the first to the last exposure in "instant" cameras is difficult. Consequently, with this invention the height of stack 60 may be increased to accommodate a larger number of film units 12 than can be accommodated in conventional self-developing film packs, for example 36 exposures as compared to 10 exposures.

After exposure in a camera, the image unit 15 is processed and separated from the adjacent image unit 15 of the film assemblage 10. The sections of connection and cover strip 14, 16, including the rupturable container 20 and the trap 22, attached to the film unit 12 can now either be retained with the image unit 15, for example by moving these sections out of the way of the imaged area by, for example folding, or these sections may be cut of along the lateral portions 42*a*, 42*b*, depending on the preference of the user.

The preferred method for attaching and/or securing and/or sealing the various elements and components to each other is by heat or pressure lamination using adhesives responsive to heat and/or pressure, also other methods, such as gluing or welding, may also be contemplated. Such attachment methods are well known in the art.

While there have been described what at present are considered to be the preferred embodiments of the present invention, it will be readily apparent to those skilled in the art that various changes may be made therein without departing from the invention, and it is intended in the claims to cover such changes and modifications as fall within the true spirit and scope of the invention.

What is claimed is:

1. An improved self-developing film unit comprising: processing fluid supply means including a rupturable reservoir of processing fluid at a leading end portion of the unit; image recording means of the self-developing type including first and second overlying layers one of which is exposable to form a latent photographic image, and spacer means connected to and between said first and second layers for providing a processing space therebetween for allowing processing fluid to pass therethrough; fluid trap means at a trailing end portion of the film unit for collecting excess processing fluid traveling through said processing space; first fluid-tight coupling means including a fluid passage for fluidically coupling said reservoir to a leading end of said processing space for allowing processing fluid from a ruptured reservoir to be introduced into said processing space and initiate processing of the latent image; and, second fluid-tight coupling means including a fluid passage for fluidically coupling a trailing end of said processing space with said trap means for allowing processing fluid to enter into said trap means; said first coupling means having one end portion sealably secured to an exterior surface of said reservoir and a second end portion sealably secured to an exterior surface of a leading end portion of said image recording means; and, said second coupling means having an end portion sealably secured to and about the trailing end portion of said image recording means and an opposite end portion sealably secured to an exterior surface of said trap means.

2. The film unit of claim 1 wherein said image recording means comprises a photosensitive layer, an image receiving layer in overlying and coextensive relationship to said photosensitive layer; said image receiving layer and said photosensitive layer being of the integral diffusion transfer type; and, said spacer means comprises a pair of spaced apart and generally parallel elongated rails coextensive with and adjacent opposed marginal edges of said layers.

3. The film unit of claim 1 wherein each of said first and second fluid-tight coupling means is made of a pair of resiliently flexible sheets which are sealably joined together to define the respective fluid passages and which are made of a foldable and rollable material to thereby facilitate folding and unfolding thereof as well as permit rolling action of the fold during folding of the film unit.

4. The film unit of claim 3 wherein said fluid passages are normally collapsible and closed to provide a zero gap therebetween when pulled between loaded compression means.

5. The film unit of claim 4 wherein said material of said first and second coupling means is made of mask material.

6. The film unit of claim 3 wherein each of said first and second coupling means defines a longitudinal extent which is sized and configured and has foldable portions for allowing folding of the film units at areas adjacent said imaging recording means, said trap means, and said reservoir, whereby said reservoir and said trap means are foldable to lie in at least a plane different from said image recording means and within confines of an area defined by said image recording means.

7. The film unit of claim 3 wherein said trap means is enclosed by and between said pair of sheets of said second coupling means.

8. The film unit of claim 7 wherein said trap means includes a sheet of processing trap material extending generally transversely to a longitudinal extent of the film unit.

9. The film unit of claim 7 wherein said trap means includes a generally V-shaped folded trap assembly extending transversely to a longitudinal extent of the film unit with one flap of said trap assembly having a surface secured to a wall portion defining the passage and another flap being unsecured to a wall portion defining the passage.

10. The film unit of claim 7 wherein said trap means includes a generally V-shaped folded trap assembly extending transversely to the longitudinal extent of the fluid trap with one flap having a surface secured to a wall portion defining said passage and another flap being secured to an opposing wall portion defining said passage.

11. The film unit of claim 1 including a plurality of film units being coupled together in longitudinally extending end-to-end relationship to each other with a leading end portion of said reservoir of one film unit being juxtaposed to a trailing end portion of an adjacent film unit; and, separable means interconnecting each linear pair of film units connected in end-to-end relationship.

12. The film unit of claim 7 including a plurality of the film units are interconnected together in longitudinally extending and end-to-end relationship to each other with a leading end portion of said reservoir of one film unit being juxtaposed to a trailing end portion of an adjacent film unit; and, means separably interconnecting leading and trailing end portions of each juxtaposed pair of film units, and allowing separation of the juxtaposed units in response to separation forces being applied to said separation means.

13. The film unit of claim 11 wherein said separable means includes a frangible connection between the adjacent film units.

14. The film unit of claim 11 wherein said separable means includes an interconnecting sheet which at one end forms a portion of said first coupling means and at another portion forms a portion of said second coupling means.

15. A method of forming a self-developing film unit comprising the steps of:

a) providing a rupturable reservoir of processing fluid;

b) providing an image recording means of the self-developing type including first and second overlying layers one of which is exposable to form a latent photographic image, and spacer means connected to and between the first and second layers for providing a processing space therebetween which allows processing fluid to pass therethrough;

c) providing fluid trap means for collecting excess processing fluid traveling through the processing space;

d) fluidically coupling the reservoir to a leading end of the processing space by providing first fluid-tight coupling means including a fluid passage for allowing processing fluid from a ruptured reservoir to be introduced into the processing space and initiate processing of the latent image;

e) fluidically coupling a trailing end of the processing space with the trap means by providing a second fluid-tight coupling means including a fluid passage for allowing processing fluid to travel from the processing space to the trap means;

f) said step of fluidically coupling the reservoir to the processing space includes having one end portion of the first coupling means sealably secured to an exterior surface of the reservoir and a second end portion sealably secured to an exterior surface of a leading end portion of the image recording means; and, g) said step of fluidically coupling the second coupling means includes having an one end portion thereof sealably secured to and about an outer surface of the trailing end portion of the image recording means, and an opposite end portion sealably secured to an exterior surface of the trap means.

16. A method of claim 15 further including the step of forming a film assemblage comprising the steps providing a plurality of film units coupled together in longitudinally extending and end-to-end relationship to each other with a leading end portion of the reservoir of one film unit being juxtaposed to a trailing end portion of an adjacent film unit; and, separably interconnecting each linear pair of adjacent film units connected in end-to-end relationship by using an interconnecting sheet which at one end forms a portion of the first coupling means and at another portion forms a portion of the second coupling means; wherein the interconnecting sheet forms a portion which is separable, whereby the adjacent pairs of the film units can be separated.

17. A method of forming a film unit of the self-developing type comprising the steps of:

a) providing linearly spaced apart first and second sheets;

b) providing an image recording means of the self-developing type including first and second overlying and coextensive layers one of which is exposable to form a latent photographic image, and spacer means connected to and between the first and second layers for providing a processing space therebetween which allows processing fluid to pass therethrough to initiate processing of the latent image;

c) securing an outer surface of a leading edge portion of one of the layers of the image recording means to an internal surface of the first sheet and securing an outer surface of a trailing edge portion of the one layer to an internal surface of the second sheet;

d) securing rupturable reservoir to the internal surface of the first sheet at a location remote from a leading portion of the one layer;

e) securing processing fluid trap means to the internal surface of the second sheet at a location remote from a trailing portion of the one layer;

f) joining a third sheet in overlying relationship to the first sheet along the marginal edges thereof so as to encompass the reservoir and so that a trailing portion of the third sheet is secured sealably to an outer surface of a leading edge portion of the one layer of the image recording means; and, g) joining a fourth sheet in overlying relationship to the second sheet along the marginal edges thereof so as to encompass the trap means and so that a leading portion of the fourth sheet is secured sealably to an outer surface of a trailing edge portion of the other layer of the image recording means, whereby a fluid passage is formed between the rupturable means and the processing space as well as a fluid passage is formed between the processing space and the trap means.

18. The method of claim 17 wherein said steps of providing sheets includes the steps of providing each of the first, second, third and fourth sheets so that each is made of material which is resiliently flexible to be foldable and rollable.

19. The method of claim 17 wherein said steps of providing sheets includes the steps of providing each of the first, second, third and fourth sheets with frangible sections so that the frangible sections of the joined pairs are in general registry with each other to define a frangible or weakened portion which are separable when subject to pulling action.

20. The method of claim 17 wherein said step of providing the image recording means includes a preliminary step of providing a roll of the image recording means having the layers in a superposed and coextensive arrangement with the spacer means therebetween, and cutting the image recording means to a preselected length.

* * * * *